US006429767B1

(12) United States Patent
Shimomura

(10) Patent No.: US 6,429,767 B1
(45) Date of Patent: Aug. 6, 2002

(54) MULTIDIRECTIONAL INPUT DEVICE

(75) Inventor: Hisato Shimomura, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/552,936

(22) Filed: Apr. 20, 2000

(30) Foreign Application Priority Data

Apr. 22, 1999 (JP) ..... 11-114914

(51) Int. Cl.[7] ..... H01C 10/16

(52) U.S. Cl. ..... 338/128; 338/129; 338/131; 200/6 A; 273/148 B

(58) Field of Search ..... 338/128, 129, 338/130, 131; 200/6 A; 273/148 B

(56) References Cited

U.S. PATENT DOCUMENTS 3,784,746 A * 1/1974 Hess ..... 338/128
4,110,721 A * 8/1978 Nakanishi et al. ..... 338/128
5,107,080 A * 4/1992 Rosen ..... 200/6 A
5,229,742 A 7/1993 Miyamoto et al.
5,496,977 A * 3/1996 Date et al. ..... 200/6 A
5,621,196 A * 4/1997 Nishijima et al. ..... 200/6 A

FOREIGN PATENT DOCUMENTS

JP 4-36618 3/1992

* cited by examiner

*Primary Examiner*—Karl D. Easthom
(74) *Attorney, Agent, or Firm*—Brinks Hofer Gilson & Lione

(57) ABSTRACT

In a multidirectional input device, a control shaft and an operating member are spline-connected so that when the control shaft is turned in the tilted state, the operating member spline-connected to the control shaft also turns even if there is friction between the bottom portion thereof and a bottom plate due to elastic pressing by an urging member. The operating member turns in a rolling manner without slipping on the bottom plate, Thereby improving the manipulation feeling of the control shaft.

12 Claims, 11 Drawing Sheets

MULTIDIRECTIONAL INPUT DEVICE

BACKGROUND OF THE INVENTION

1. Field of the Invention

The present invention relates to a multidirectional input device, and more particularly, to a multidirectional input device in which a plurality of electric parts can be simultaneously operated by manipulating a control shaft.

2. Description of the Related Art

In a conventional multidirectional input device, as shown in FIGS. 14–16, a first interlock member 31 curved in an arch form is placed inside a box-shaped frame 30 that is surrounded by side plates and is open at the bottom. The first interlock member 31 has mounting portions 31*a* at both ends, and is turnably laid in the frame 30 with the mounting portions 31 fitted in holes 30*a* and 30*c* formed in the side plates of the frame 30.

The end faces of the mounting portions 31*a* are provided with holes 34 with which rotation shafts 33 of variable resistors 32 serving as rotary electric parts are engaged. The arched portion of the first interlock member 31 has a slot 35 extending in the longitudinal direction.

Below the first interlock member 31, a second interlock member 40 is positioned to extend in a direction intersecting the first interlock member 31. The second interlock member 40 is made of metal by die-casting or by other methods, and has a spherical portion 41 at the center. Arm portions 42 horizontally extend right and left from the spherical portion 41. Circular mounting portions 42*a* project at the leading ends of the arm portions 42, and are fitted in holes 30*b* and 30*d* formed in the frame 30, whereby the second interlock member 40 is rotatably supported in the frame 30.

Holes 43 are formed in the end faces of the mounting portions 42*a*, and rotation shafts 33 of variable resistors 32 are press-fitted and engaged with the holes 43.

A slot 45 vertically penetrates through the center of the spherical portion 41. The first and second interlock members 31 and 40 are positioned so that the slot 35 and the slot 45 intersect.

A control shaft 36 is passed through the slot 45 of the second interlock member 40. The control shaft 36 is made of metal or the like, and has an oval support portion 38 at the center. Sticklike columns formed integrally with the support portion 38 vertically protrude from the top and bottom thereof.

A disklike spring bearing 47 is formed integrally with the control shaft 36 at a position of the downward protruding column close to an end portion 36*a*.

The support portion 38 of the control shaft 36 has a small hole 39. The small hole 39 and a hole 44 formed through the second interlock member 40 are aligned with each other, a round pin 46 of a metal or the like is inserted or press-fitted in the aligned holes 39 and 44, and both ends of the round pin 46 are caulked, whereby the control shaft 36 is tiltably mounted in the second interlock member 40.

The column of the control shaft 36 extending upward from the support portion 38 is passed through the slot 35 of the first interlock member 31. By tilting the control shaft 36 in the direction along the slot 35, the second interlock member 40 can be turned or rotated on the mounting portions 42*a*. A grip 55 is fixedly mounted at the upper end of the control shaft 36 that extends upward through the slot 35.

An operating member 37 made of resin or the like and having a saucerlike outer shape is mounted at the bottom end portion 36*a* of the control shaft 36. The operating member 37 has a boss portion 37*a* projecting at the center, and the end portion 36*a* of the control shaft 36 is inserted in a hole 50 formed through the boss portion 37*a*, thereby allowing the operating member 37 to move vertically.

A bottom plate 49 is positioned to close the open bottom of the frame 30. The bottom of the operating member 37 is in elastic contact with the bottom plate 49.

The first interlock member 31 can be turned on the mounting portions 31*a* by tilting the control shaft 36 on the round pin 46 along the slot 45 of the second interlock member 40, and the second interlock member 40 can be turned on the mounting portions 42*a* by tilting the control shaft 36 in the direction along the slot 35 of the first interlock member 31.

The rotation shafts 33 of the variable resistors 32 retained on the side plates of the frame 30 are press-fitted in the holes 34 and 43 of the first and second interlock members 31 and 40, respectively, so that the first and second interlock members 31 and 40 and the variable resistors 32 move together.

A substantially conical return spring 48 is placed between the spring bearing 47 of the control shaft 36 and the inner bottom face of the operating member 37. The operating member 37 is elastically contacted with the bottom plate 49 by elastic force of the return spring 48, so that the control shaft 36 is biased in the neutral upright position.

The operation of the conventional multidirectional input device will be described below. First, as shown in FIG. 15, when the control shaft 36 is in a non-operation state, it is in the neutral upright position with its upper end protruding up from a hole 56 of the upper side plate of the frame 30, and the operating member 37 is horizontally placed in elastic contact with the bottom plate 49 by the return spring 48.

By tilting the control shaft 35 from the neutral state along the slot 45 of the second interlock member 40 (for example, rightward or in the clockwise direction, as shown in FIG. 16), the first interlock member 31 is turned or rotated. This in turn operates the variable resistor 32 to change the resistance thereof.

With the tilting operation of the control shaft 36, the operating member 37 is tilted, as shown in FIG. 16, and a part of the rim of the tilted operating member 37 moves in sliding contact with the inner bottom face of the bottom plate 49. With this, the operating member 37 moves toward the circular spring bearing 47, thereby compressing and bending the return spring 48.

When operating force applied to the control shaft 36 is removed, the elastic force of the return spring 48 causes the tilted operating member 37 to move in sliding contact with the inner bottom face of the bottom plate 49, which moves toward the horizontal position with respect to the inner bottom face of the bottom plate 49, and the control shaft 36 automatically returns to the neutral upright position shown in FIG. 15.

In order to operate the variable resistor 32 engaged with the arm portion 42 of the second interlock member 40, the second interlock member 40 is turned by tilting the control shaft 36 along the slot 35 of the first interlock member 31, thereby changing the resistance of the variable resistor 32.

In the tilting operation, the control shaft 36 contacts the end of the slot 35 of the first interlock member 31 or the end of the slot 45 of the second interlock member 40, thereby constructing a stopper for the tilting operation.

The control shaft 36 can also circulate around the round pin 46 in the tilted state shown in FIG. 16.

The end portion 36*a* of the control shaft 36 is fitted in the circular hole 50 of the operating member 37. When the control shaft 36 is circulated, the bottom of the operating member 37 is elastically pressed against the bottom plate 49 by the return spring 48, and friction arises between the bottom of the operating member 37 and the bottom plate 49. Since this frictional force is greater than that between the end portion 36*a* and the hole 50, the operating member 37 also circulates while the bottom of the operating member 37 slips on the bottom plate 49.

In the above-described conventional multidirectional input device, however, since the end portion 36*a* of the control shaft 36 is fitted in the circular hole 50 of the operating member 37, when the control shaft 36 is circulated in the tilted state, friction arises between the bottom of the operating member 37 and the bottom plate 40 because of elastic pressing by the return spring 48. For this reason, the bottom of the operating member 37 moves while slipping on the bottom plate 49, and the slip is transmitted to the control shaft 36, or the operating member 37 is chipped and changes its shape, which impairs the manipulation feeling.

SUMMARY OF THE INVENTION

Accordingly, it is an object of the present invention to provide a multidirectional input device with a superior manipulation feeling.

According to a first arrangement for overcoming the above problems, there is provided a multidirectional input device including: a frame; first and second interlock members turnably mounted in the frame so as to intersect each other; a control shaft placed perpendicularly to the first and second interlock members and held by the second interlock member so as to be tilted to turn the first and second interlock members; a bottom plate placed so as to intersect the axial direction of the control shaft; an operating member held by the control shaft to move in the axial direction of the control shaft; an urging member for elastically pressing the bottom of the operating member against the bottom plate; and electric parts operated via the first and second interlock members by the tilting operation of the control shaft, wherein the control shaft and the operating member are spline-connected.

According to a second preferred arrangement, the control shaft is provided with a cylindrical portion for holding the urging member, and the inner wall of the cylindrical portion and the outer wall of the operating member are spline-connected.

According to a third preferred arrangement, the control shaft is provided with a plurality of ribs extending in the axial direction, and is spline-connected by fitting the ribs in grooves formed in the operating member.

Further objects, features, and advantages of the present invention will become apparent from the following description of the preferred embodiments with reference to the attached drawings.

DESCRIPTION OF THE PREFERRED EMBODIMENT

Figure 1:
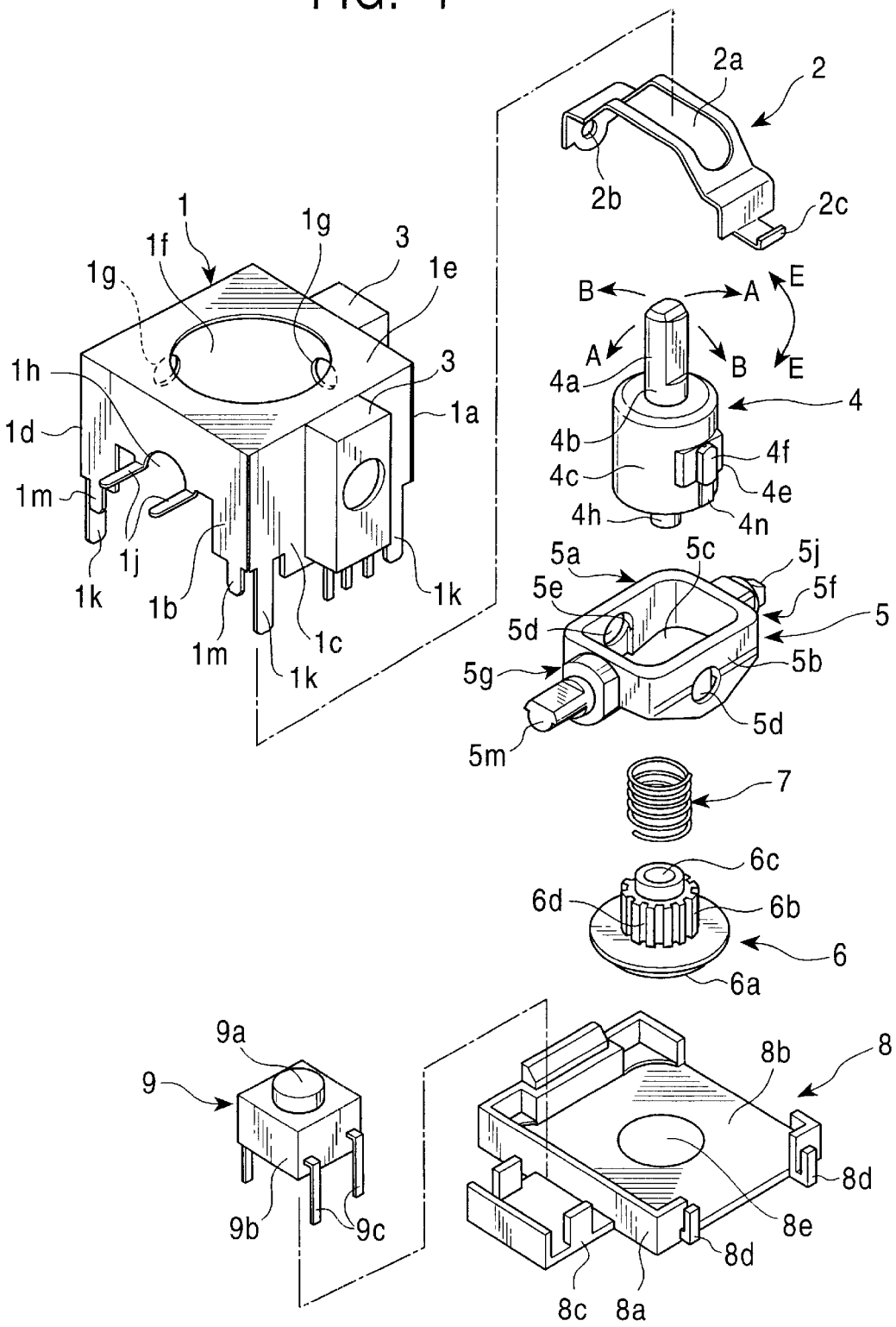
FIG. 1 is an exploded perspective view of a multidirectional input device according to the present invention.
Figure 5:
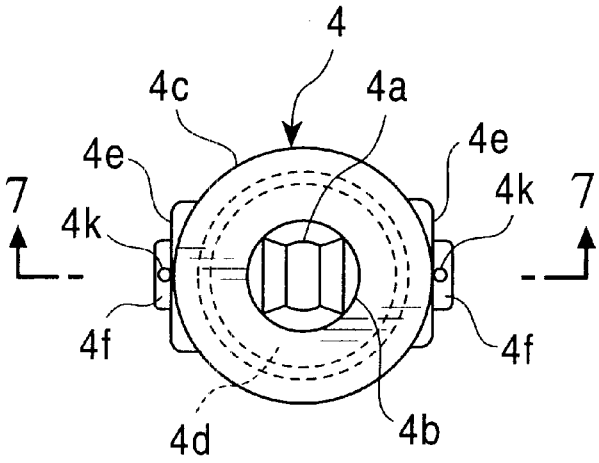
FIG. 5 is a top view of a control shaft for use in the multidirectional input device of the present invention.
Figure 6:
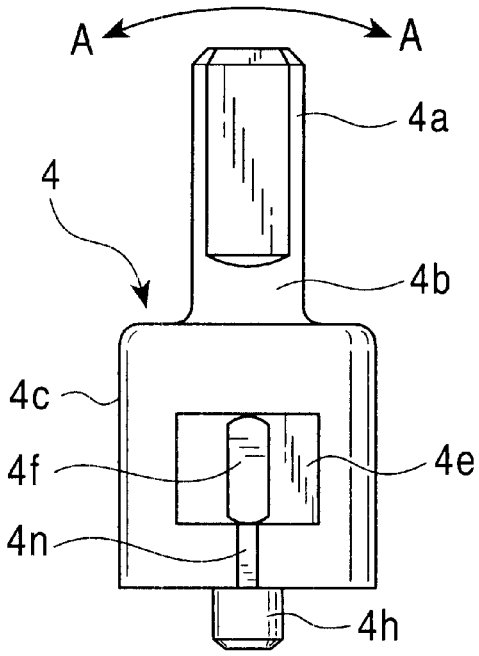
FIG. 6 is a front view of the control shaft.
Figure 7:
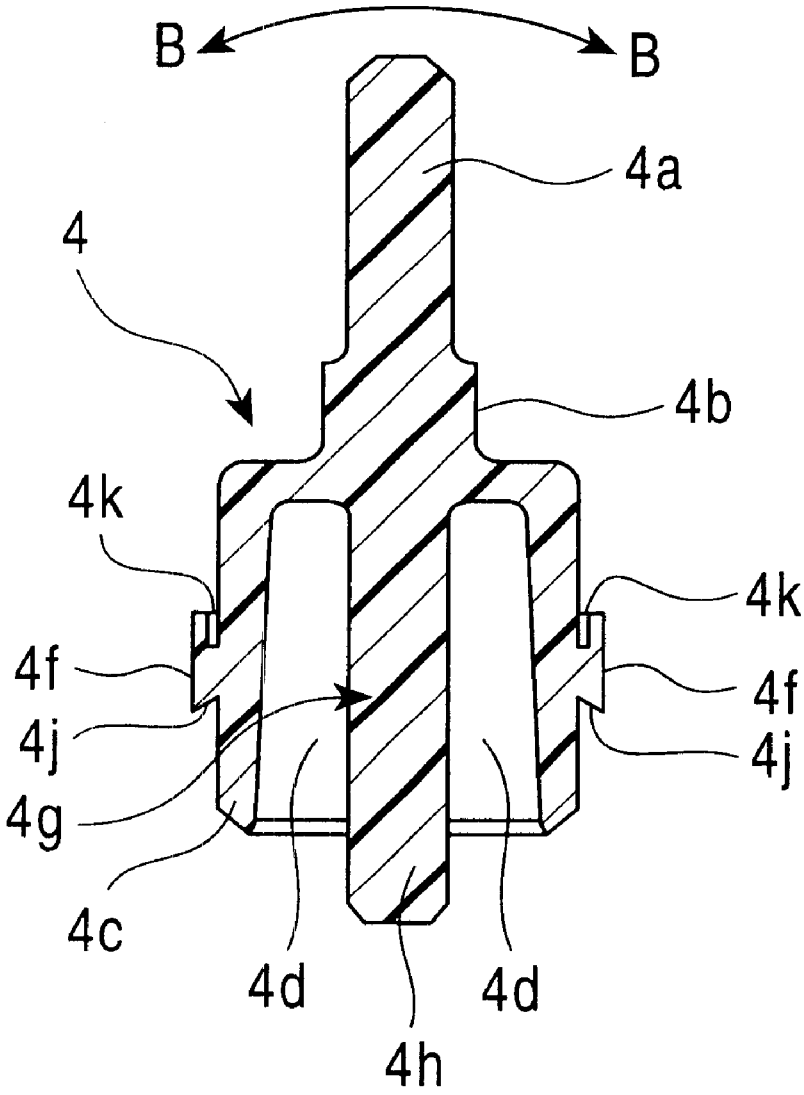
FIG. 7 is a cross-sectional view of the control shaft taken along line 7—7 in FIG. 5.
Figure 8:
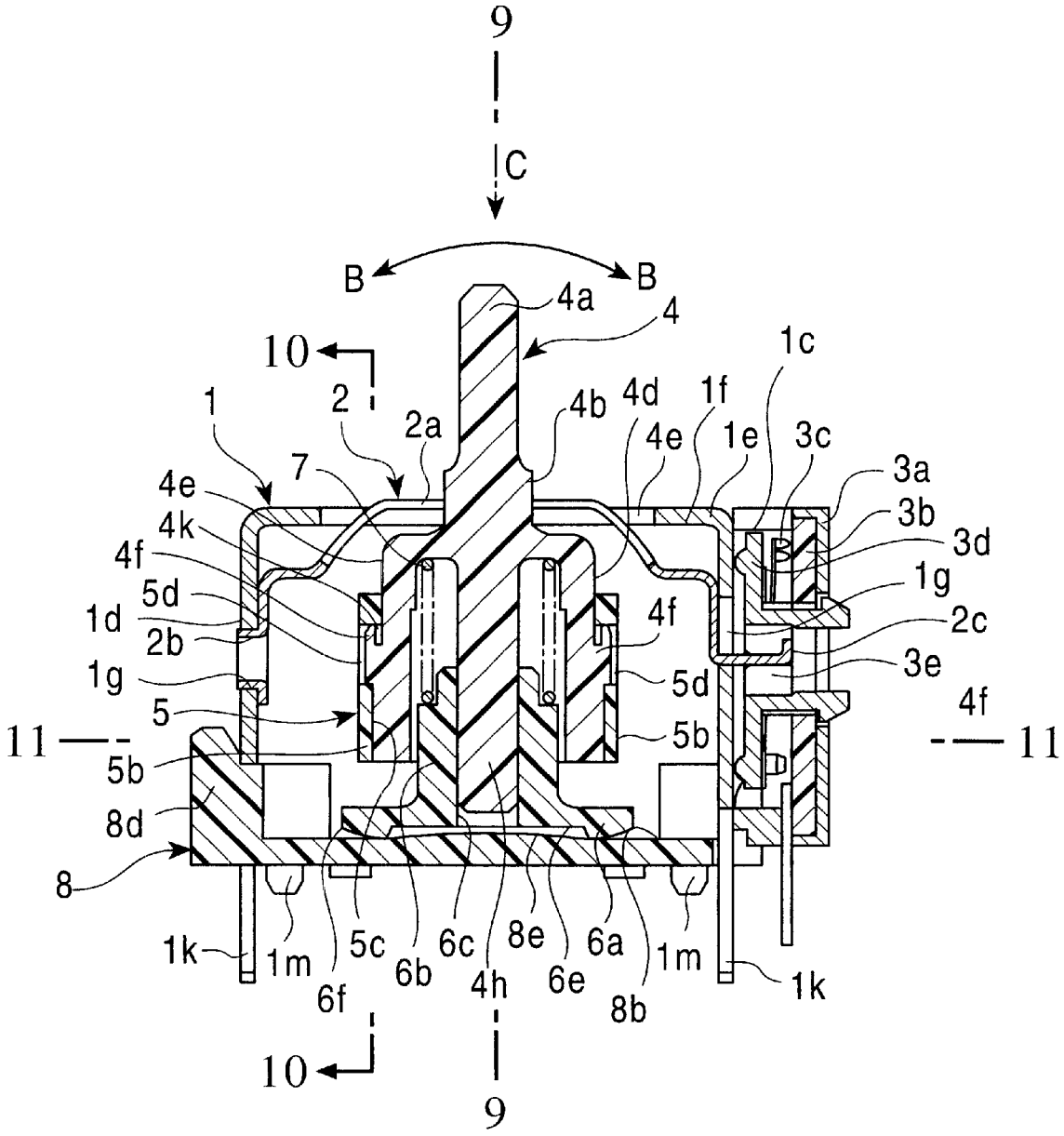
FIG. 8 is a longitudinal sectional view of the principal part of the multidirectional input device.
Figure 9:
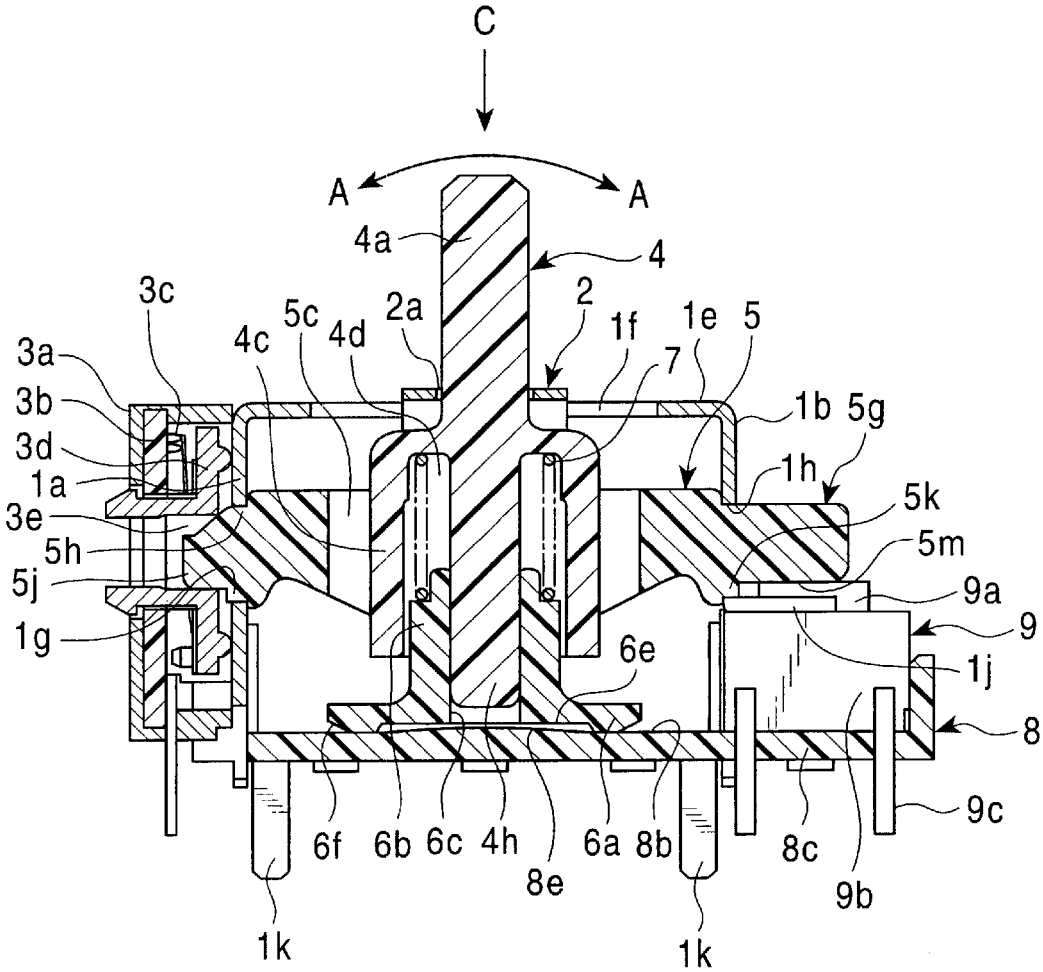
FIG. 9 is a sectional view of the multidirectional input device taken along line 9—9 in FIG. 8.
Figure 10:
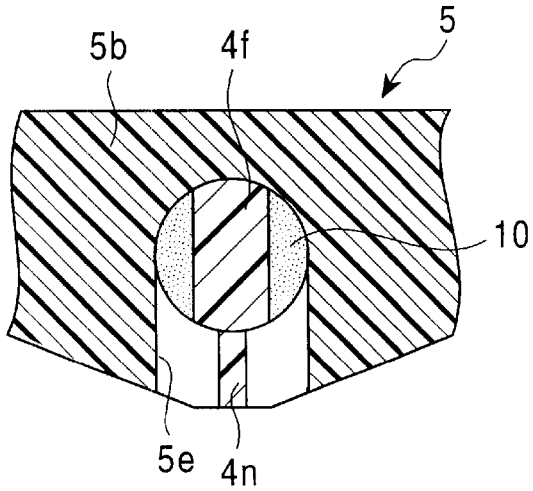
FIG. 10 is a sectional view of the principal part of the multidirectional input device taken along line 10—10 in FIG. 8.
Figure 11:
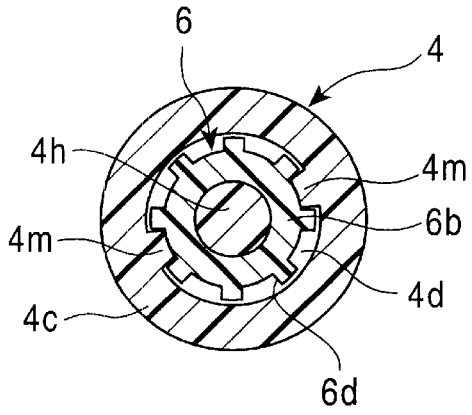
FIG. 11 is a sectional view of the principal part of the multidirectional input device taken along line 11—11 in FIG. 8.
Figure 12:
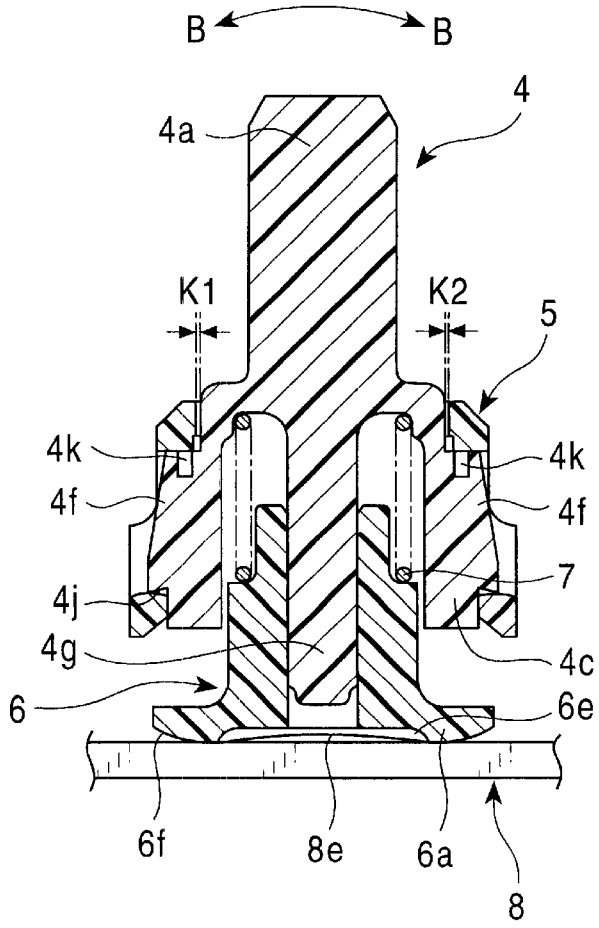
FIG. 12 is an explanatory view showing the operation of the multidirectional input device of the present invention.
Figure 13:
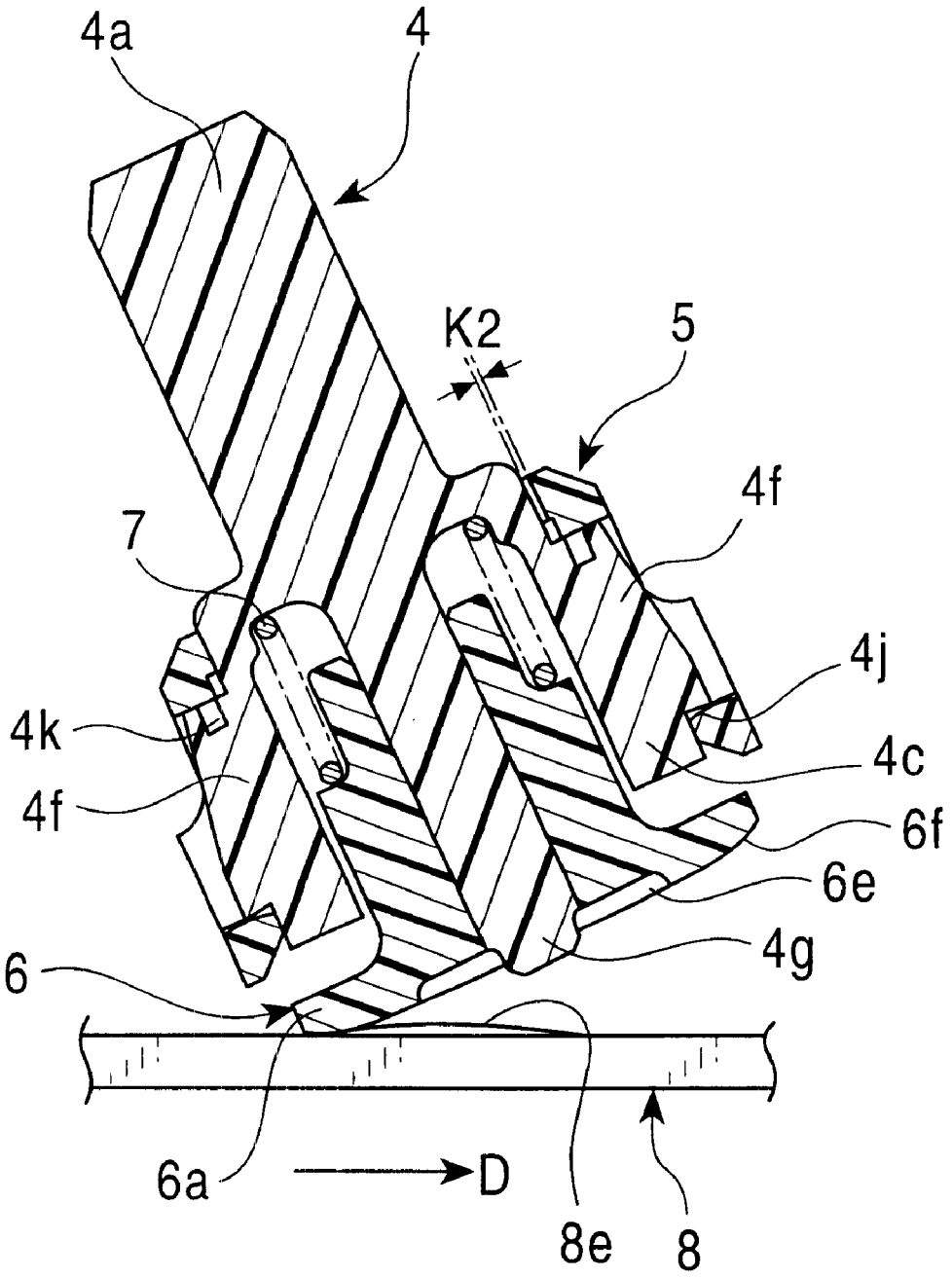
FIG. 13 is an explanatory view showing the operation of the multidirectional input device.
Figure 14:
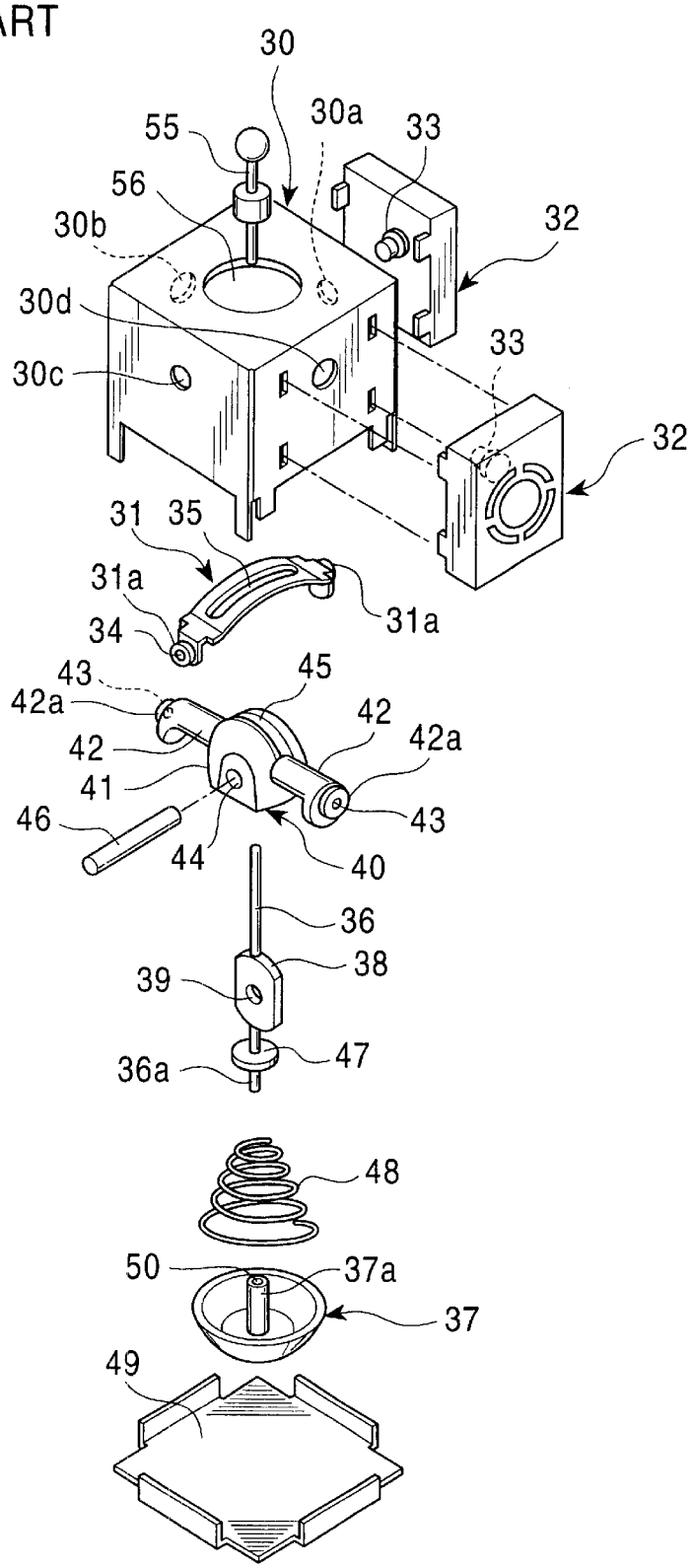
FIG. 14 PRIOR ART
FIG. 14 is an exploded perspective view of a conventional multidirectional input device.
Figure 15:
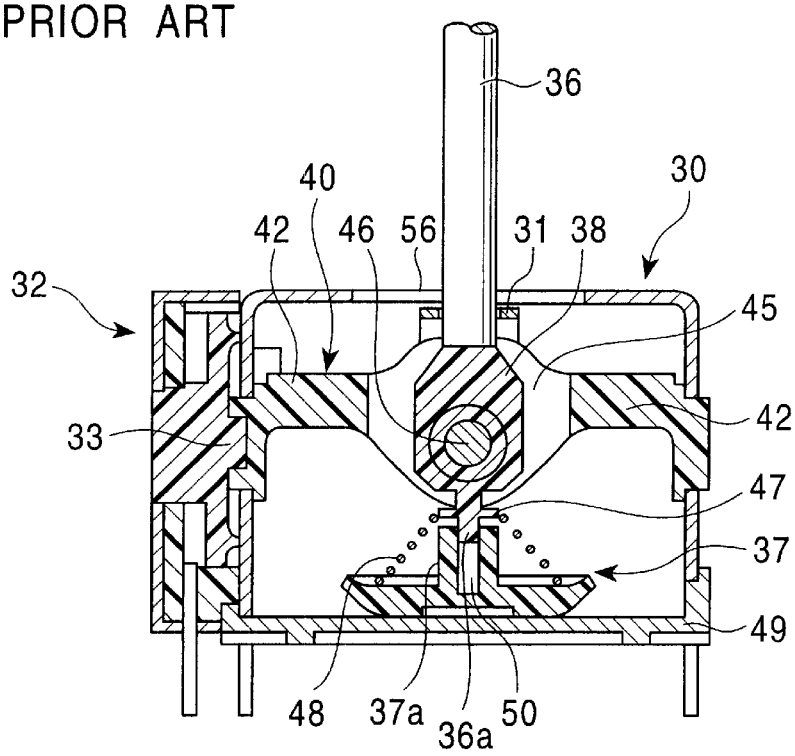
FIG. 15 PRIOR ART
FIG. 15 is an explanatory view showing the operation of the conventional multidirectional input device.
Figure 16:
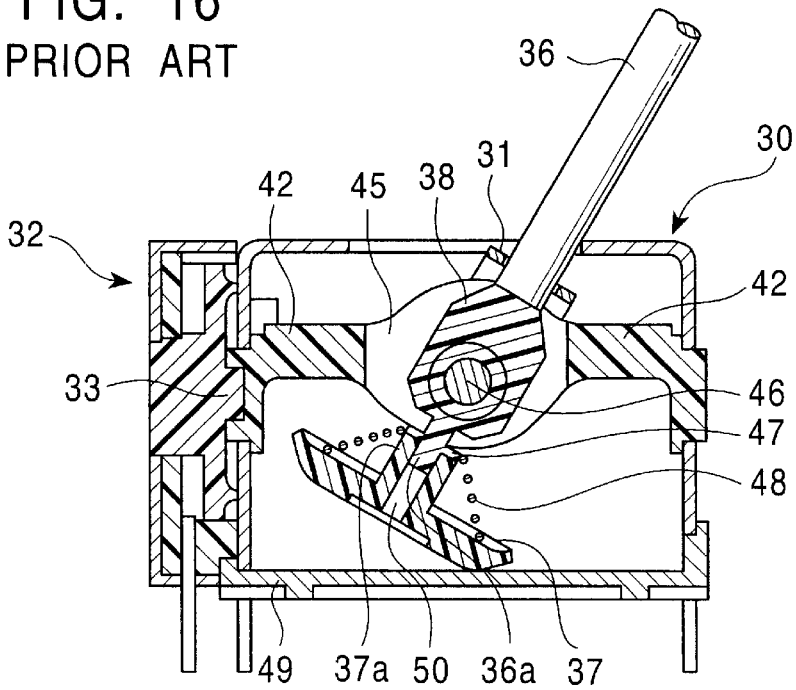
FIG. 16 PRIOR ART
FIG. 16 is an explanatory view showing the operation of the conventional multidirectional input device.

A multidirectional input device according to an embodiment of the present invention will be described below with reference to FIGS. 1 to 13. FIG. 1 is an exploded perspective view of a multidirectional input device according to the present invention, FIGS. 2, 3, 4A and 4B are explanatory views of a second interlock member in the multidirectional input device, FIGS. 5 to 7 are explanatory views of a control shaft in the multidirectional input device, FIG. 8 is a longitudinal sectional view of the principal part of the multidirectional input device, FIG. 9 is a longitudinal sectional view of the multidirectional input device taken along line 9—9 in FIG. 8, FIG. 10 is a sectional view of the principal part of the multidirectional input device taken along line 10—10 in FIG. 8, FIG. 11 is a sectional view of the principal part of the multidirectional input device taken along line 11—11 in FIG. 8, and FIGS. 12 and 13 are explanatory views showing the operation of the multidirectional input device.

Referring to FIG. 1, the multidirectional input device of the present invention is provided with a frame 1 made of an iron plate or the like. The frame 1 includes side plates 1*a*, 1*b*, 1*c*, and 1*d* bent downward by pressing or by other methods, is open at the bottom with a cavity therein, and is outwardly shaped nearly like a rectangular parallelepiped. The top of the frame 1 is covered with an upper plate 1*e* having an operating hole 1*f* at the center.

The three side plates 1*a*, 1*c*, and 1*d* (excluding the side plate 1*b*) have circular holes 1*g*, and the side plates 1*a* and 1*c* also have a plurality of square holes (not shown) for mounting variable resistors 3 serving as rotary electric parts (which will be described later). The side plate 1*b* opposed to the side plate 1*a* has a substantially semicircular support portion 1*h* at a position opposed to the circular hole 1*g* of the side plate 1*a*. Part presser bars 1*j* are formed on the right and left sides of the support portion 1*h* so as to be substantially perpendicularly bent outward from the side plate 1*b*.

The opposing side plates 1*c* and 1*d* have, at the bottoms, a plurality of mounting terminals 1*k* extending downward by which the multidirectional input device is mounted on a printed board or the like (not shown).

The side plates 1*a* and 1*b* have, at the bottoms, tongues 1*m* used to mount a bottom plate 8 (which will be described below).

A first interlock member 2 made of a phosphor-bronze plate or the like is placed inside the cavity of the frame 1. The first interlock member 2 is curved upward in an arched form by pressing or by other methods, and the arched portion is provided with a slot 2*a* formed by stamping so as to extend in the longitudinal direction.

Both ends of the first interlock member 2 are bent downward. At one of the bent ends (on the left side in the figure), a pipelike support portion 2*b* is formed by drawing or by other methods, and is fitted in the circular hole 1*g* of the side plate 1*d* so as to be turnably supported thereat.

The other right end of the first interlock member 2 is bent nearly in a U-shape to form a part operating portion 2*c*. The part operating portion 2*c* is protruded outward through a circular hole (not shown) formed in the side plate 1*c* of the frame 1, and is engaged with a horizontal groove of a sliding-element supporting member 3*d* of a variable resistor 3 (which will be described below).

The first interlock member 2 is laid between the circular holes 1*g* of the side plates 1*c* and 1*d* of the frame 1 so that the arched portion is turnably placed inside the frame 1.

Electric parts (for example, variable resistors 3) are mounted, by snap-fitting or by other methods, at the plural square holes (not shown) formed in the side plate 1*a* and the adjoining side plate 1*c* of the frame 1.

In the variable resistor 3 serving as a rotary electric part, as shown in FIG. 8, a substrate 3*b* is formed integrally with a casing 3*a* by insert molding or by other methods and is placed inside the casing 3*a*. A sliding-element supporting member 3*d* with a sliding element 3*c* is turnably mounted on the substrate 3*b* by snap-fitting or by other methods. An operating portion 3*e* having an engagement groove, constituted by a combination of a vertical groove and a horizontal groove, is formed at the turning center of the sliding-element supporting member 3*d*.

The substantially U-shaped part operating portion 2*c* of the first interlock member 2 protruding outward from the circular hole (not shown) of the side plate 1*c* of the frame 1 is engaged with the operating portion 3*e* of the variable resistor 3 mounted on the side plate 1*c*. When the first interlock member 2 turns, the sliding-element supporting member 3*d* of the variable resistor 3 also turns, thereby changing the resistance of the variable resistor 3.

A grip portion 4*a* of a control shaft 4 is passed through the slot 2*a* of the first interlock member 2, and the grip portion 4*a* and a root portion 4*b* are movable along the slot 2*a*. The control shaft 4 is made of synthetic resin or the like, and the grip portion 4*a* and the root portion 4*b* are oval and circular, respectively, as shown in FIGS. 5 to 7. Under the circular root portion 4*b*, a cylindrical portion 4*c* is formed integrally therewith.

The cylindrical portion 4*c* is open at the bottom, is surrounded by an outer wall, and has therein a holding portion 4*d* for holding an urging member 7 formed of a substantially circular return spring (which will be described below). Flat portions 4*e* are formed opposed to each other on the outer wall of the cylindrical portion 4*c*, as shown in FIG. 5. Oval shaft portions 4*f* having a predetermined diameter and a predetermined height project from the flat portions 4*e* in the direction orthogonal to the axial direction of the control shaft 4.

On the lower surface of each of the shaft portions 4*f*, a slope portion 4*j* is formed to be gradually inclined upward from the leading end of the shaft portion 4*f* toward the center of the control shaft 4, as shown in FIG. 7.

A concave grease storing portion 4*k* is formed on the arc-shaped upper surface of the shaft portion 4*f*.

Inside the holding portion 4*d*, a shaft support portion 4*g* is formed integrally with and coaxially with the grip portion 4*a* so as to extend downward in the figure. A bottom end 4*h* of the shaft support portion 4*g* protrudes downward from the cylindrical portion 4*c*.

A plurality of ribs 4*m* extending in the axial direction are formed on the inner wall of the cylindrical portion 4*c* so as to project into the holding portion 4*d*, particularly, as shown in FIG. 11.

On the outer wall of the cylindrical portion 4*c*, projections 4*n* constituting stoppers are formed on the lower-sides of the shaft portions 4*f*.

The shaft portions 4*f* are turnably supported by a second interlock member 5, which allows the control shaft 4 to tilt in the directions of the arrow A.

The second interlock member 5 is made of synthetic resin, and is placed below the first interlock member 2 so as to extend in the direction orthogonal to the first interlock member 2.

Figure 2:
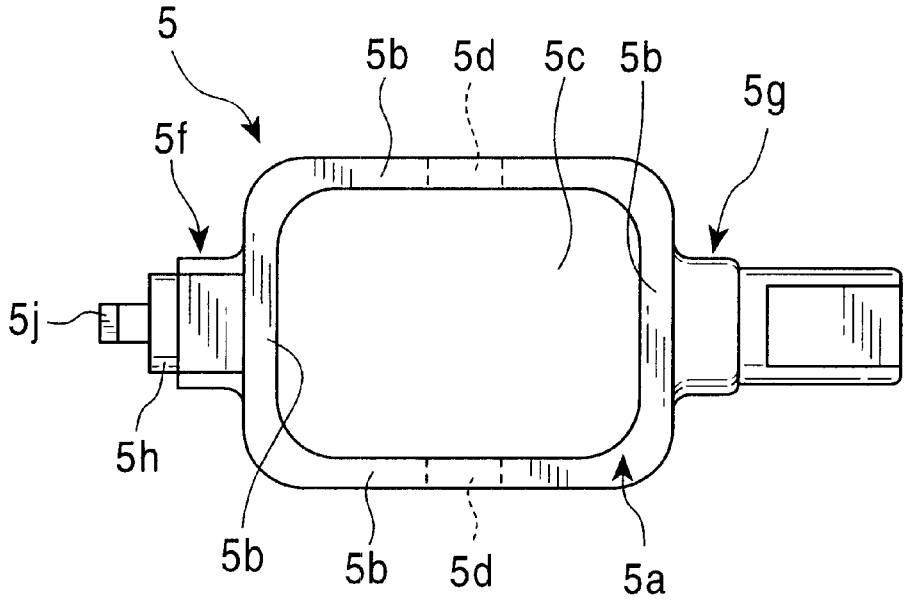
FIG. 2 is a top view of a second interlock member for use in the multidirectional input device of the present invention.
Figure 3:
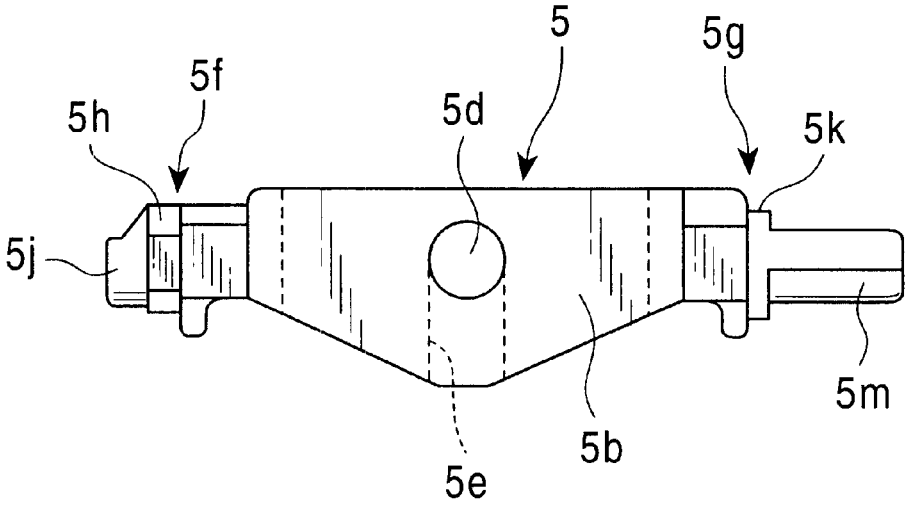
FIG. 3 is a front view of the second interlock member.
Figure 4A:
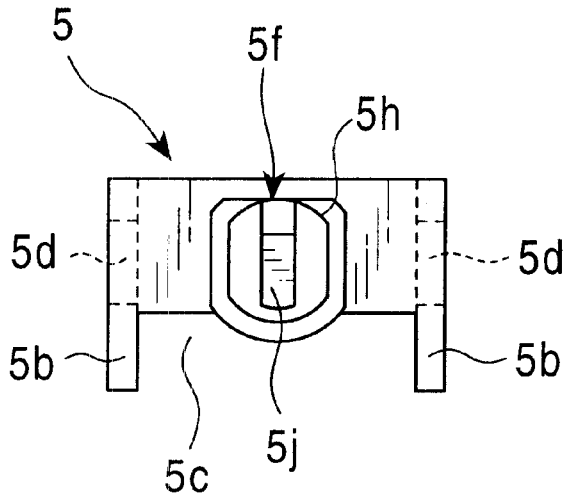
FIGS. 4A and 4B are side views of the second interlock member.
Figure 4B:
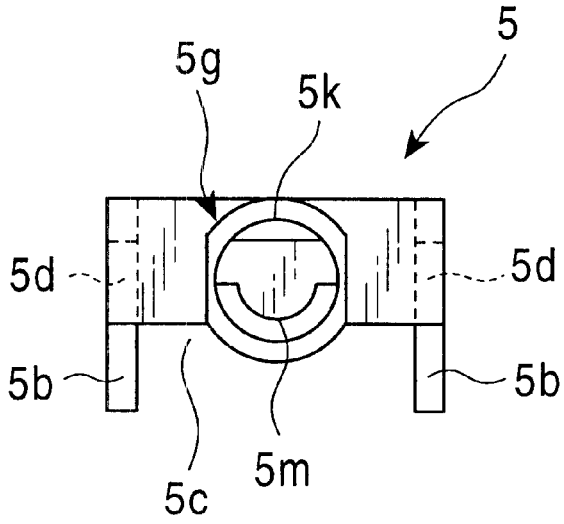

The second interlock member 5 has a support section 5*a*, which is substantially rectangular in outer shape and has a center opening 5*c* at about the center for passing the control shaft 4 therethrough, particularly, as shown in FIGS. 2 to 4. The support section 5*a* comprises side walls 5*b* that are long crosswise and lengthwise, and substantially surrounds the rectangular center opening 5*c*.

Circular holes 5*d* are formed through or as concavities of a predetermined depth, at fixed positions of the side walls 5*b* of the support section 5*a* that are long crosswise, with which the shaft portions 4*f* of the control shaft 4 are engaged. The lower inner faces of the circular holes 5*d* are tapered along the slope portions 4*j* of the shaft portions 4*f*.

On the inner sides of the side walls 5*b*, stopper portions 5*e* are formed of recesses for receiving the projections 4*n* and are disposed below and close to and the circular holes 5*d*, particularly, as shown in FIG. 10.

The shaft portions 4*f* of the control shaft 4 are snapped into the circular holes 5*d*. Thereby, the control shaft 4 is held by the second interlock member 5, and the projections 4*n* abut on the stopper portions 5*e* to constitute stoppers.

After this assembly, the inner sides of the side walls 5*b* are in contact with the flat portions 4*e* on the periphery of the control shaft 4, and the upper and lower portions of the oval shaft portions 4*f* are in contact with the inner faces of the circular holes 5*d*.

First and second arm portions 5*f* and 5*g* horizontally extend from the support section 5*a* to the right and left sides, as shown in FIG. 3. The first arm portion 5*f* extending to one side is provided with a support portion 5*h* having a given diameter, and a platelike part operating portion 5*j* having a given width projects from the support portion 5*h*.

The second arm portion 5*g* extending to the other side is provided with a support portion 5*k* having a given diameter, and a part operating portion 5*m* extends from the support portion 5*k* so as to be flat at the top and to be semicircular at the bottom.

In the second interlock member 5, the support portion 5*h* of the first arm portion 5*f* is fitted in the circular hole 1*g* formed in the side plate 1*a* of the frame 1 and is turnably supported thereat, and the support portion 5*k* of the second arm portion 5*g* is supported at the semicircular support portion 1*h* of the side plate 1*b*. The second interlock member 5 is thereby turnably placed inside the frame 1 to allow the control shaft 4 to be tilted in the direction on the arrow B and so that the part operating portion 5*m* at one end is movable vertically.

The part operating portion 5*j* of the first arm portion 5*f* is engaged with the vertical groove of the operating portion 3*e* of the variable resistor 3 mounted on the side plate 1*a*, and the part operating portion 5*m* of the second arm portion 5*g* is placed on an electric part mounted on the bottom plate 8, for example, a stem portion 9*a* of a pushbutton switch 9 (which will be described below).

At the bottom end 4*h* of the control shaft 4, an operating member 6 is placed to move in the axial direction of the control shaft 4.

The operating member 6 is made of resin, and has, in the lower part, a base portion 6*a* that is circular in outer shape and has a lower surface curved like a saucer. A cylindrical boss portion 6*b* projects upward from the center of the base portion 6*a*, and a shaft hole 6*c* is formed through the center of the boss portion 6*b*.

The boss portion 6*b* of the operating member 6 is provided with a plurality of grooves 6*d* so as to be spline-connected to the ribs 4*m* of the control shaft 4. The base portion 6*a* has a recess 6*e* at the center of the lower surface, and an arc-shaped face portion 6f on the periphery of the lower surface.

The shaft support portion 4*g* of the control shaft 4 is passed through the shaft hole 6*c* of the operating member 6, and the boss portion 6*b* is movably fitted in the holding portion 4*d* of the cylindrical portion 4*c*.

In this case, the ribs 4*m* of the control shaft 4 are spline-connected to the grooves 6d of the operating member 6, whereby the operating member 6 is allowed to turn with the control shaft 4.

The urging member 7 formed of a coil spring having a predetermined elastic force is placed inside the holding portion 4*d* in the cylindrical portion 4*c* of the control shaft 4 so that the upper and lower coil ends of the urging member 7 are in elastic contact with the ceiling face of the holding portion 4*d* and the upper surface of the boss portion 6*c* of the operating member 6. The urging member 7 is fitted on the shaft support portion 4*g*. One end of the urging member 7 on the side of the grip portion 4*a* is guided by the inner wall of the cylindrical portion 4*c*, and the other end is guided by the outer wall of the boss portion 6*b*, thereby regulating the frontward, rearward, rightward, and leftward movements of the urging member 7.

Below the operating member 6, the bottom plate 8 is placed to close the bottom of the frame 1. The bottom plate 8 is made of resin, is substantially rectangular in outer shape, and is partially provided with side walls 8*a* on the periphery. A flat inner bottom face 8*b* is formed inside the side walls 8*a*.

A conical projection 8*e* shaped like a saucer is formed on the inner bottom face 8*b*, and has a taper portion that gradually rises from the periphery toward the center.

The bottom of the operating member 6 is elastically contacted with the inner bottom face 8*b* by the urging member 7. A part mounting portion 8*c* projects from the side wall 8*a* on one side of the bottom plate 8 so as to mount thereon an electric part, for example, the pushbutton switch 9. A plurality of guide portions 8*d* project from the side walls 8*a* adjoining the side wall 8*a* with the part mounting portion 8*c* so as to position the bottom ends of the side plates 1*c* and 1*d* of the frame 1.

The pushbutton switch 9 to be mounted on the part mounting portion 8*c* comprises the stem portion 9*a* for opening and closing an inner switch circuit (not shown), a casing 9*b* for hermetically sealing the switch circuit, and a plurality of mounting terminals 9*c* extending downward from the side faces of the casing 9*b*. In such a pushbutton switch 9, the mounting terminals 9*c* can be temporarily fixed to the part mounting portion 8*c* of the bottom plate 8 by snap-fitting or by other means.

In order to assemble the above-described multidirectional input device of the present invention, first, the arched first interlock member 2 is inserted into the frame 1 from the open bottom side, the part operating portion 2*c* is inserted in the circular hole (not shown) of the side wall 1*c*, and the support portion 2*b* is inserted in the circular hole 1*g* of the side wall 1*d*, whereby the first interlock member 2 is placed inside the frame 1.

Next, the cylindrical portion 4*c* of the control shaft 4 is placed in the center opening 5*c* of the second interlock member 5, and the oval shaft portions 4*f* are placed on the side walls 5*b*.

When the control shaft 4 is pressed into the center opening 5*c* by a jig (not shown), the side walls 5*b* are elastically deformed and are stretched outward, and the shaft portions 4*f* are snap-fitted in the circular holes 5*d* formed in the side walls 5*b*. The control shaft 4 is thereby turnably supported by the second interlock member 5.

Next, grease is injected into grease storing portions 10 (see FIG. 10), formed by spaces formed between linear portions on both sides of the oval shaft portions 4*f* and the circular holes 5*d*, in order to prevent problems, such as jarring, in a sliding portion between the control shaft 4 and the second interlock member 5. Moreover, grease also spreads and is stored in the grease storing portions 4*k* of the control shaft 4, thereby preventing problems such as jarring.

Subsequently, the grip portion 4*a* of the control shaft 4 turnably supported by the second interlock member 5 is passed through the slot 2*a* of the first interlock member 2, and is protruded outward from the operating hole 1*f* of the frame 1 so that the circular root portion 4*b* is placed at the slot 2*a*.

The support portion 5*h* of the first arm portion 5*f* of the second interlock member 5 is inserted in the circular hole 1*g* of the side plate 1*a* of the frame 1, the part operating portion 5*j* at the leading end is protruded outward from the side plate 1*a*, and the support portion 5*k* of the second arm portion 5*g* is placed at the support portion 1*h* of the side plate 1*b* of the frame 1.

The frame 1, in which the first and second interlock members 2 and 5 are laid, is inverted so that the open bottom side points upward. The urging member 7 is inserted and held in the holding portion 4*d* of the cylindrical portion 4*c* of the inverted control shaft 4.

When the shaft hole 6*c* of the operating member 6 is fitted on the shaft support portion 4*g* of the control shaft 4, the boss portion 6*b* of the operating member 6 is spline-connected to the interior of the cylindrical portion 4*c* of the control shaft 4, is movably fitted therein, and is elastically contacted with the urging member 7.

The bottom plate 8, in which the pushbutton switch 9 is temporarily mounted on the part mounting portion 8*c*, is inverted and placed on the inverted frame 1. Then, the bottom plate 8 is positioned on the frame 1 with the end of the side plate 1*c* guided by the guide portions 8*d*, and the part presser bars 1*j* of the side plate 1*b* are placed on the upper surface of the casing 9 of the pushbutton switch 9, whereby the pushbutton switch 9 is fixed on the bottom plate 8.

By caulking the plural tongues 1*m* formed in the side plates 1*a* and 1*b* of the frame 1, the bottom plate 8 is fixedly combined with the frame 1, the bottom of the operating member 6 is elastically contacted with the inner bottom face 8*b* of the bottom plate 8, and the control shaft 4 is placed into the neutral upright position, as show in FIGS. 8, 9, and 12.

The operating portion 3*e* of the variable resistor 3 is engaged with the part operating portion 5*j* of the second interlock member 5 that protrudes outward from the circular hole 1*g* of the side plate 1*a*, and the variable resistor 3 is snap-fitted in the plural square holes (not shown) formed in the side plate 1*a*, whereby the variable resistor 3 is retained by the side plate 1*a*.

Furthermore, the operating portion 3*e* of the variable resistor 3 is similarly engaged with the part operating portion 2*c* of the first interlock member 2 protruding outward from the side plate 1*c*, and the variable resistor 3 is retained by the side plate 1*c*. Assembling of the multidirectional input device of the present invention is then completed.

While the electric parts formed of the variable resistors 3 are mounted on the frame 1 after the first and second interlock members 2 and 5 are mounted in the frame 1 in the above-described assembly operation, the variable resistors 3 may be mounted on the discrete frame 1 before the first and second interlock members 2 and 5 are mounted therein.

Description will now be given of the operation of the multidirectional input device of the present invention. When an operating force is not applied to the grip portion 4*a* of the control shaft 4 (i.e., when no load is imposed), the operating member 6 is elastically contacted with the inner bottom face 8*b* of the bottom plate 8 by elastic force of the urging member 7, the saucerlike bottom face of the base portion 6*a* is in the horizontal position, and the control shaft 4 is in the neutral upright position, as shown in FIGS. 8 and 12. In this neutral state, the projection 8*e* of the bottom plate 8 is placed inside the recess 6*e* of the operating member 6.

When the control shaft 4 in this neutral position is tilted along the slit 2*a* of the first interlock member 2 in the direction B—B in FIGS. 8 and 12, the second interlock member 5 is turned on the support portions 5*h* and 5*k* of the first and second arm portions 5*f* and 5*g*, the bottom face of the base portion 6*a* in the operating member 6 moves in sliding contact with the inner bottom face 8*b* of the bottom plate 8, as shown in FIG. 13, and the operating member 6 tilts while the arc-shaped face portion 6*f* on the lower periphery of the base portion 6*a* contacts the taper portion of the projection 8*e* of the bottom plate 8.

The boss portion 6*b* of the operating member 6 is pressed into the holding portion 4*d* of the cylindrical portion 4*c* of the control shaft 4 against the elastic force of the urging member 7.

In this case, in the neutral state shown in FIG. 12, clearances K1 and K2 (serving as play) are formed on the right and left sides of the control shaft 4 between the control shaft 4 and the second interlock member 5 because of the connection structure therebetween.

When the control shaft 4 is initially tilted, the clearance K1 on the tilting side is lost, and the clearance K2 on the opposite side increases.

When the tilting operation is continued, the arc-shaped face portion 6*f* of the operating member 6 slides while running on the taper portion of the projection 8*e*, which regulates the movement of the operating member 6. For this reason, even when the operating member 6 is tilted by a given angle, the arc-shaped face portion 6*f* does not slip on the bottom plate 8 in the direction of the arrow D in FIG. 13. This allows the tilting operation to be performed while the state of the clearance K2 is maintained.

When the second interlock member 5 is turned, the sliding-element supporting member 3*d* of the variable resistor 3 engaged with the part operating portion 5*j* of the first arm portion 5*f* is turned to change the resistance.

When the control shaft 4 is tilted in the direction of the arrow B, it contacts the end of the slit 2*a* of the first interlock member 2, and stops the tilting operation.

When the operating force applied to the control shaft 4 is removed, the operating member 6 automatically returns to the horizontal state because of the elastic force of the urging member 7, and the control shaft 4 automatically returns to the neutral upright position.

In contrast, when the control shaft 4 is tilted along the center opening 5*c* of the second interlock member 5 in the direction A—A in FIG. 9, the first interlock member 2 turns on the support portion 2*b* and the part operating portion 2*c*.

When the first interlock member 2 turns, the sliding-element supporting member 3*d* of the variable resistor 3 mounted on the side plate 1*c* and engaged with the part operating portion 2*c* is turned, thereby changing the resistance of the variable resistor 3. The operation of the operating member 6 in this case is the same as the above-described operation when the control shaft 4 is tilted in the direction B—B, and therefore the description thereof has been omitted.

When the control shaft 4 is tilted in the direction of the arrow A, the projections 4*n* move in the recesses and abut on the stopper portions 5*e*, which thereby constitute stoppers.

The control shaft 4 can be tilted throughout a range of 360°. The control shaft 4 in the tilted state can also be turned in the direction of the arrow E in FIG. 1. In this case, the operating member 6 spline-connected to the control shaft 4 turns together, and the bottom of the base portion 6*a* of the operating member 6 turns in a rolling manner without slipping on the bottom plate 8 even when there is friction therebetween due to elastic pressing by the urging member 7.

Description will now be given of the operation of the pushbutton switch 9 serving as an electric part in addition to the variable resistors 3. First, the control shaft 4 is pressed down in the direction of the arrow C (see FIG. 8). Pressing force is thereby applied to the circular holes 5*d* of the second interlock member 5, and the second arm portion 5*g* turns downward on the support portion 5*h* of the first arm portion 5*f*.

Then, the part operating portion 5*m* of the second arm portion 5*g* protruding outward from the support portion 1*h* of the side plate 1*b* moves vertically, and presses the stem portion 9*a* of the pushbutton switch 9 to turn the pushbutton switch 9 on and off.

The control shaft 4 may be pressed in the direction of the arrow C not only in the neutral position, but also when it is tilted to control the resistance of the variable resistor 3.

While the shaft portions 4*f* of the control shaft 4 are formed of oval projections and the second interlock member 5 has the circular holes 5*d* in the above description of the embodiment, the shaft portions 4 may be recessed and the circular holes 5*d* may be replaced with projections.

While both the control shaft 4 and the second interlock member 5 are made of an elastically deformable resin material or the like, one of the control shaft 4 and the second interlock member 5 may be made of metal by die-casting.

While the variable resistors 3 and the pushbutton switch 9 are adopted as the plural electric parts, they may be replaced with rotary electric parts, such as an encoder, or electric parts to be operated by pushing.

While the cylindrical portion 4*c* of the control shaft 4 is open at the bottom and is surrounded by the outer wall, a part of the outer wall excluding the portions having the shaft portions 4*f* may be open. In this case, the shaft portions 4*f* are more likely to be elastically deformed, which improves workability in snap-fitting.

While the projection 8*e* of the bottom plate 8 is conical, it may have at least a tapered portion in the direction in which the control shaft 4 is turnably supported by the second interlock member 5, that is, in the first interlock member forming direction. This prevents the tactile feel in tilting the control shaft 4 due to the clearances K1 and K2 existing in the turnable support direction.

The inner wall of the shaft hole 6*c* of the operating member 6 and the outer wall of the shaft support portion 4*g* of the control shaft 4 may be spline-connected.

The grease storing portions 4*k* and the like may be provided in a sliding portion between the control shaft 4 and the first or second interlock member 2 or 5 in order to prevent jarring or the like.

The stopper portions 5*e* formed of recesses for receiving the projections 4*n* of the control shaft 4 may be provided at appropriate positions in the second interlock member 5.

According to the multidirectional input device of the present invention, since the control shaft 4 and the operating member 6 are spline-connected, when the tilted control shaft 4 is turned in the direction of the arrow E (see FIG. 1), the operating member 6 spline-connected to the control shaft 4 also turns even if there is friction between the bottom portion thereof and the bottom plate 8 due to elastic pressing by the urging member 7. The operating member 6 turns in a rolling manner without slipping on the bottom plate 8. Therefore, it is possible to provide a multidirectional input device in which the manipulation feeling of the control shaft 4 is more desirable than before.

The control shaft 4 has the cylindrical portion 4*c* for holding the urging member 7, and the inner wall of the cylindrical portion 4*c* and the outer wall of the operating member 6 are spline-connected. Therefore, it is possible to provide a multidirectional input device in which the diameters of the portions to be spline-connected are increased, the play in spline connection is reduced, rattling is prevented, and the operating member 6 rolls appropriately.

The control shaft 4 has the plural ribs 4*m* extending in the axial direction, and is spline-connected by engaging the ribs 4*m* with the grooves 6*d* of the operating member 6. Therefore, it is possible to provide a multidirectional input device in which the spline-connecting strength is increased, and the operating member 6 stably moves in the axial direction.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A multidirectional input device comprising:

a frame;

first and second interlock members turnably mounted in said frame so as to intersect each other;

a control shaft having an axial direction positioned perpendicularly to said first and second interlock members and held by said second interlock member so as to be tilted to turn said first and second interlock members;

a bottom plate placed so as to intersect the axial direction of said control shaft;

an operating member held by said control shaft so as to be moveable in the axial direction of said control shaft;

an urging member for elastically pressing a bottom of said operating member against said bottom plate; and electric parts operated via said first and second interlock members by the tilting operation of said control shaft, wherein said control shaft is provided with a shaft support portion and a cylindrical portion, said shaft support portion being disposed along the axial direction of the control shaft and configured to movably engage a central portion of the operating member, said cylindrical portion being spaced away from said shaft support portion so as to form an interior area for holding said urging member, said urging member being disposed between an inner wall of said cylindrical portion and an outer wall of said shaft support portion, and wherein the inner wall of the cylindrical portion is spline-connected with an outer wall of said operating member.

2. A multidirectional input device according to claim 1, wherein the inner wall of said cylindrical portion is provided with a plurality of ribs extending in the axial direction of said control shaft, and said control shaft is spline-connected to said operating member by fitting said ribs in grooves formed in the outer wall of said operating member.

3. A multidirectional input device according to claim 1, wherein the cylindrical portion of said control shaft is pivotally connected to said second interlock member.

4. A multidirectional input device according to claim 1, wherein the urging member is biased against an end of the operating member.

5. A multidirectional input device according to claim 4, wherein the end of the operating member comprises a boss portion for positioning said urging member.

6. A multidirectional input device according to claim 1, wherein the urging member comprises a spring.

7. A multidirectional input device comprising:

a frame;

first and second interlock members disposed at right-angles to each other and turnably mounted in said frame;

a control shaft having an axis oriented so as to intersect said first and second interlock members, wherein said control shaft passes through a slot in said first interlock member and is pivotally supported by said second interlock member so that said first and second interlock members are turned by a tilting operation of said control shaft and said control shaft is prevented from rotating about its axis;

a bottom plate placed so as to intersect the axis of said control shaft;

an operating member held by said control shaft so as to be moveable in a direction along the axis of said control shaft, said operating member comprising a bottom surface configured to slide along the bottom plate in response to the tilting operation of said control shaft;

an urging member for elastically pressing the bottom surface of said operating member against said bottom plate; and electric parts operated via said first and second interlock members by the tilting operation of said control shaft, wherein said control shaft is provided with a shaft support portion and a cylindrical portion, said shaft portion being disposed along the axis of the control shaft and configured to movably engage a central portion of the operating member, said cylindrical portion being spaced away from said shaft support portion so as to form an interior area for holding said urging member, said urging member being disposed between an inner wall of said cylindrical portion and an outer wall of said shaft support portion, and wherein said control shaft and said operating member are spline-connected to each other so that said operating member is prevented from rotating about the axis of said control shaft and is prevented from rotating relative to said bottom plate during the tilting operation of the control shaft, the inner wall of the cylindrical portion being spline-connected with an outer wall of said operating member.

8. A multidirectional input device according to claim 7, wherein the inner wall of said cylindrical portion is provided with a plurality of ribs extending in the direction of the axis of said control shaft, and said control shaft is spline-connected to said operating member by fitting said ribs in grooves formed in the outer wall of said operating member.

9. A multidirectional input device according to claim 7, wherein the cylindrical portion of said control shaft is pivotally connected to said second interlock member.

10. A multidirectional input device according to claim 7, wherein the urging member is biased against an end of the operating member.

11. A multidirectional input device according to claim 10, wherein the end of the operating member comprises a boss portion for positioning said urging member.

12. A multidirectional input device according to claim 7, wherein the urging member comprises a spring.

* * * * *